US008411885B2

(12) United States Patent
Kornagel et al.

(10) Patent No.: US 8,411,885 B2
(45) Date of Patent: Apr. 2, 2013

(54) METHOD FOR OPERATING A HEARING APPARATUS AND HEARING APPARATUS WITH A FREQUENCY SEPARATING FILTER

(75) Inventors: Ulrich Kornagel, Erlangen (DE); Stefan Petrausch, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 346 days.

(21) Appl. No.: 12/767,064

(22) Filed: Apr. 26, 2010

(65) Prior Publication Data

US 2010/0272289 A1 Oct. 28, 2010

Related U.S. Application Data

(60) Provisional application No. 61/172,259, filed on Apr. 24, 2009.

(30) Foreign Application Priority Data

Apr. 24, 2009 (DE) ..... 10 2009 018 812

(51) Int. Cl.
*H04R 25/00* (2006.01)

(52) U.S. Cl. ..... 381/312

(58) Field of Classification Search ..... 381/312
See application file for complete search history.

(56) References Cited

U.S. PATENT DOCUMENTS

| | | | | |
|---|---|---|---|---|
| 4,099,035 | A * | 7/1978 | Yanick | 381/320 |
| 4,790,018 | A | 12/1988 | Preves et al. | |
| 4,882,762 | A | 11/1989 | Waldhauer | |
| 5,278,912 | A | 1/1994 | Waldhauer | |
| 5,285,502 | A | 2/1994 | Walton et al. | |
| 5,832,097 | A * | 11/1998 | Armstrong et al. | 381/321 |
| 5,987,146 | A | 11/1999 | Pluvinage et al. | |
| 6,163,513 | A * | 12/2000 | Yamanaka | 369/44.35 |
| 6,181,801 | B1 | 1/2001 | Puthuff et al. | |
| 6,831,986 | B2 | 12/2004 | Kates | |
| 7,957,710 | B2 * | 6/2011 | Kawamoto et al. | 455/127.1 |
| 8,180,081 | B2 | 5/2012 | Lunner | |
| 2004/0109578 | A1 | 6/2004 | Niederdrank et al. | |
| 2010/0272289 | A1 * | 10/2010 | Kornagel et al. | 381/94.3 |
| 2011/0150256 | A1 | 6/2011 | Baechler et al. | |

FOREIGN PATENT DOCUMENTS

| | | | |
|---|---|---|---|
| DE | 19619312 | A1 | 11/1997 |
| DE | 10244184 | B3 | 4/2004 |
| DE | 69922940 | T2 | 12/2005 |
| EP | 1742509 | A1 | 1/2007 |
| WO | 9320669 | A1 | 10/1993 |
| WO | 9711572 | A1 | 3/1997 |
| WO | 0002418 | A1 | 1/2000 |
| WO | 2009143898 | A1 | 12/2009 |

OTHER PUBLICATIONS

Audio Feedback, Wikipedia, Apr. 13, 2009, pp. 1-3.

* cited by examiner

*Primary Examiner* — Jianchun Qin
(74) *Attorney, Agent, or Firm* — Laurence A. Grenberg; Werner H. Stemer; Ralph E. Locher

(57) ABSTRACT

A method operates a hearing apparatus. The hearing apparatus contains a frequency separating filter characterized by a threshold frequency, which splits an input signal into a low-frequency signal component and a high-frequency signal component. The hearing apparatus further has a first device, which can be used to set the threshold frequency of the frequency separating filter so that artifacts in an output signal of the hearing apparatus are reduced.

8 Claims, 3 Drawing Sheets

FIG. 3A
PRIOR ART
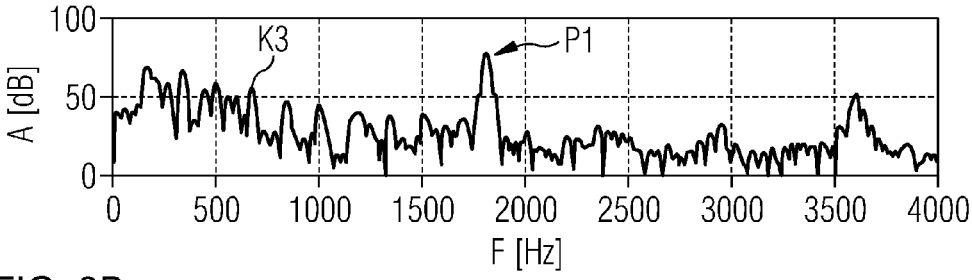
FIG. 3B
PRIOR ART
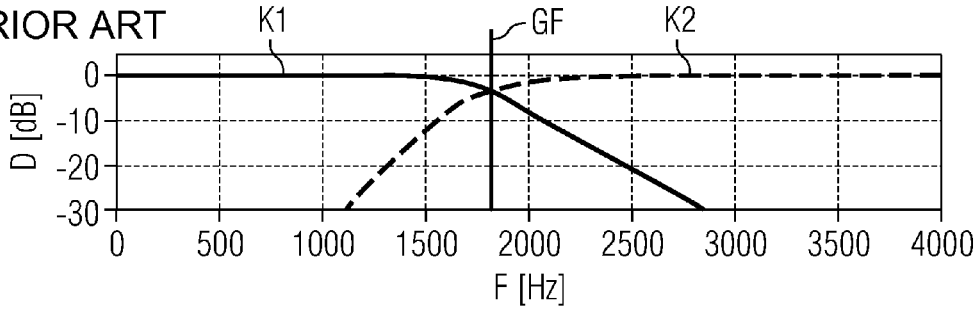
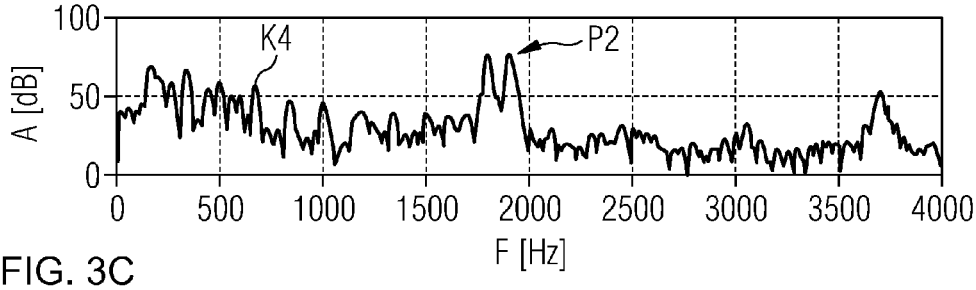
FIG. 3C
PRIOR ART FIG. 4A
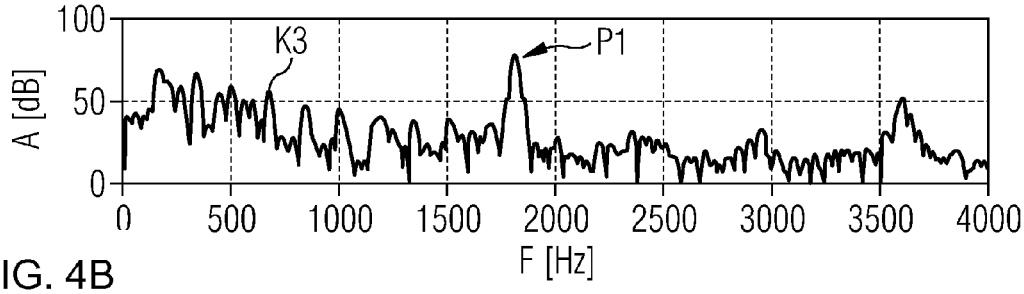
FIG. 4B
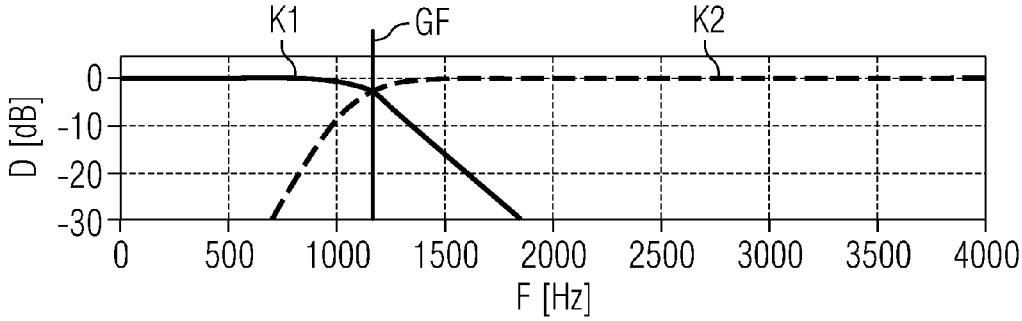
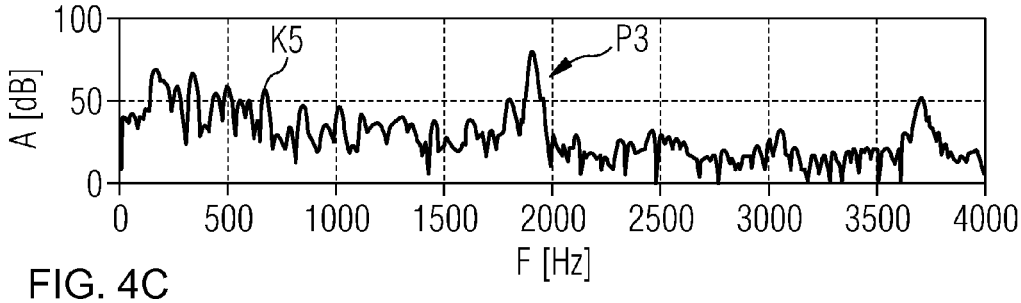
FIG. 4C
FIG. 5
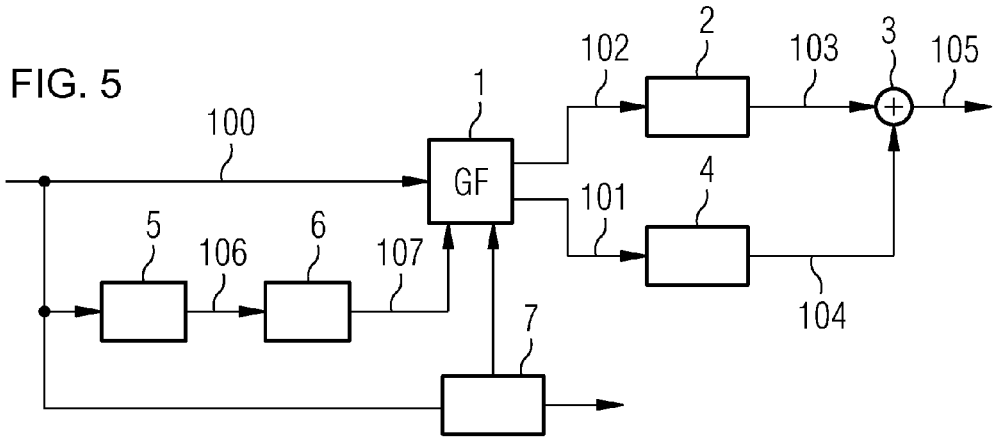

METHOD FOR OPERATING A HEARING APPARATUS AND HEARING APPARATUS WITH A FREQUENCY SEPARATING FILTER

CROSS-REFERENCE TO RELATED APPLICATION

This application claims the priority, under 35 U.S.C. §119(e), of provisional application No. 61/172,259, filed Apr. 24, 2009; and this application further claims the priority, under 35 U.S.C. §119, of German application DE 10 2009 018 812.6, filed Apr. 24, 2009; the prior applications are herewith incorporated by reference in their entirety.

BACKGROUND OF THE INVENTION

Field of the Invention

The invention relates to a method for operating a hearing apparatus and a hearing apparatus with a frequency separating filter.

In hearing apparatuses, in particular in hearing devices, frequency-distorting algorithms are used for different purposes and at different points in signal processing. For example a hearing device with a combination of audio compression and feedback suppression is known from German Utility Model DE 699 22 940 T2. All frequency-distorting algorithms share the fact that they are generally only intended to be active from what is known as a threshold frequency, because distortions of low frequencies interfere tremendously with the auditory impression while distortions of high frequencies are less critical.

FIG. 1 shows a block circuit diagram of an exemplary realization of frequency distortion in a hearing device. An input signal 100 is split by a frequency separating filter 1 (split-band filter) with a predefinable threshold frequency GF (split frequency) into a low-frequency and a high-frequency signal component 101, 102. The high-frequency signal component 102 is then distorted in a frequency distorter 2. The distorted output signal 103 is fed to an input of an adding unit 3. The low-frequency signal component 101 passes through an all-pass filter 4, which rotates the phase of the signal component 101 so that a subsequent signal addition in the adding unit 3 does not result in signal cancellation in the region of the threshold frequency GF. The phase-rotated low-frequency signal component 104 is fed to a further input of the adding unit 3. The sum of the two signal components 103, 104 is available as an output signal 105 at the output of the adding unit 3.

Frequency separating filters are not ideal and have finite frequency overlapping at their threshold frequency GF. FIG. 2 by way of example shows the frequency response of a frequency separating filter in a hearing device with the threshold frequency GF 1800 Hz. The curves K1, K2 show the attenuation D in dB as a function of the frequency F in Hz in the range 0 to 4000 Hz. The curve K1 shows a low-pass characteristic and the curve K2 a high-pass characteristic.

If the low-pass K1 filtered signal component is not distorted and the high-pass K2 filtered signal component is distorted, addition of the components K1, K2 results primarily in the region of the threshold frequency GF in non-negligible overlay of both signal components, which is perceived in an output signal of the hearing device as modulation or significant roughness. Both effects are very disruptive and are perceived by a hearing device wearer generally much more significantly than the frequency distortion per se.

As well as this "electrical" signal overlay, an acoustic overlay of a frequency-distorted and a non-frequency-distorted signal can also result. Acoustic overlay cannot be ignored, particularly in low frequency ranges and with an open hearing device supply. Direct sound is overlaid with the frequency-distorted signal component output by the hearing device, which in turn produces the artifacts described above.

SUMMARY OF THE INVENTION

It is accordingly an object of the invention to provide a method for operating a hearing apparatus and a hearing apparatus with a frequency separating filter which overcome the above-mentioned disadvantages of the prior art methods and devices of this general type, which reduces the occurrence of artifacts when undistorted and frequency-distorted signal components are overlaid.

The invention claims a method for operating a hearing apparatus by splitting an input signal into a low-frequency and a high-frequency signal component via a frequency separating filter and by setting a threshold frequency of the frequency separating filter based on an analysis of the input signal so that artifacts in an output signal of the hearing apparatus are reduced. The invention has the advantage that artifacts resulting from signal overlay can be avoided.

A development of the method can involve a distortion, for example a compression or displacement, of the high-frequency signal component and an overlaying of the low-frequency signal component and the distorted high-frequency signal component to form the output signal, in which process it is possible for artifacts to be formed.

A further embodiment of the method includes a determination of the threshold frequency by analyzing the signal level or tonality of the input signal.

The method can preferably include setting of the threshold frequency to a frequency, at which the input signal has the lowest possible signal level and/or the lowest possible tonality. This effectively minimizes artifacts which result from overlapping bands of the frequency separating filter.

The method can also involve feedback detection, with the threshold frequency being momentarily lowered when feedback is identified. This has the advantage that feedback whistling as a result of an unfavorable threshold frequency is avoided.

The invention also claims a hearing apparatus having a frequency separating filter characterized by a threshold frequency, which splits an input signal into a low-frequency and a high-frequency signal component. The hearing apparatus also contains a first device, which can be used to set the threshold frequency of the frequency separating filter based on an analysis of the input signal so that artifacts in an output signal of the hearing device are reduced. The first device can be a switching logic unit.

A further embodiment of the invention can contain a frequency distorter, which distorts, for example compresses or displaces, the high-frequency signal component. The hearing apparatus can also have an adding unit, which forms the output signal by overlaying the low-frequency signal component with the distorted high-frequency signal component, in which process it is possible for artifacts to be formed.

In one development the first device can determine the threshold frequency by analyzing the signal level or tonality of the input signal.

The first device can preferably set the threshold frequency to a frequency, at which the input signal has the lowest possible signal level and/or the lowest possible tonality.

The hearing apparatus can also contain feedback suppression with a feedback detector, which momentarily lowers the threshold frequency when feedback occurs.

Other features which are considered as characteristic for the invention are set forth in the appended claims.

Although the invention is illustrated and described herein as embodied in a method for operating a hearing apparatus and a hearing apparatus with a frequency separating filter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIGS. 3A-3C are graphs showing frequency responses in a hearing device according to the prior art;

FIGS. 4A-4C are graphs showing frequency responses in a hearing device according to the invention; and FIG. 5 is a block circuit diagram of an inventive configuration.

DETAILED DESCRIPTION OF THE INVENTION

Figure 1:
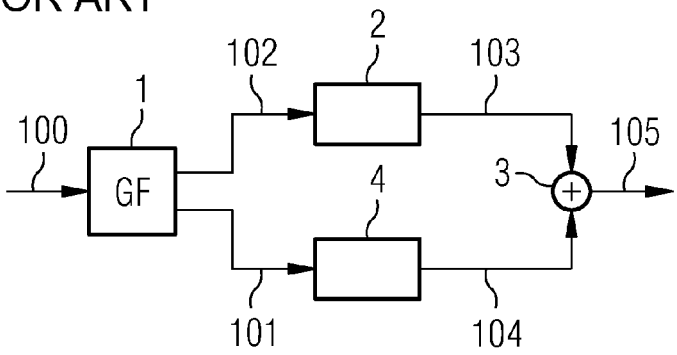
FIG. 1 PRIOR ART
FIG. 1 is a block circuit diagram of an arrangement with a frequency separating filter according to the prior art.
Figure 2:
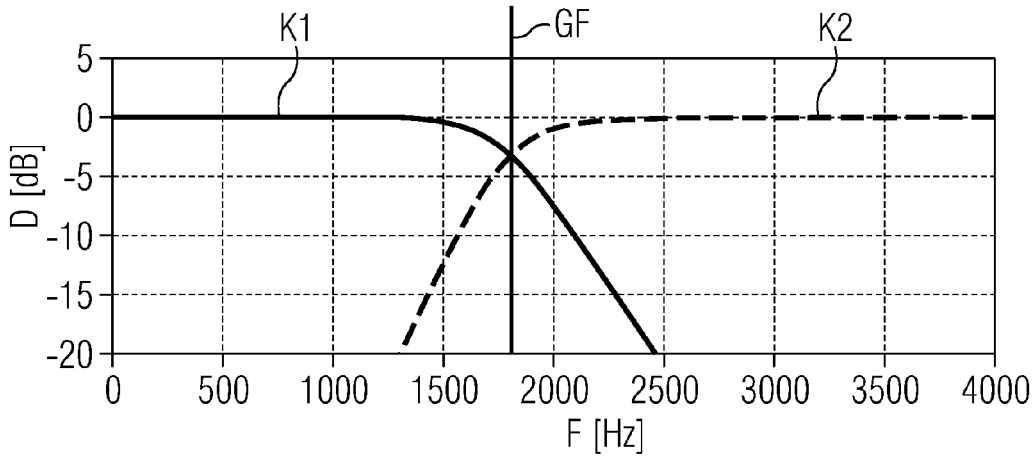
FIG. 2 PRIOR ART
FIG. 2 is a graph showing a frequency response of a frequency separating filter according to the prior art.

Referring now to the figures of the drawing in detail and first, particularly, to FIGS. 3A-3C thereof, there is shown three graphs illustrating the effect of the threshold frequency GF of a frequency separating filter in a hearing apparatus in a typical application. The upper graph FIG. 3A shows the frequency response K3 of a signal amplitude A in dB of an input signal, for example a microphone signal, as a function of the frequency F in Hz between 0 and 4000 Hz. A flute tone with a base tone P1 unfavorably coincides precisely with the threshold frequency GF 1800 Hz of the frequency separating filter.

FIG. 3B shows the frequency response of the frequency separating filter with a threshold frequency GF at 1800 Hz. The curves K1, K2 show the attenuations D in dB as a function of the frequency F in Hz. The curve K1 shows a low-pass characteristic and the curve K2 a high-pass characteristic. A low-frequency and a high-frequency signal component are therefore available at the outputs of the frequency separating filter. The high-frequency signal component is now displaced upward in frequency by 100 Hz.

If the high-frequency signal component, the frequency of which has been displaced by 100 Hz, and the undistorted low-frequency signal component are added together, this gives a frequency response K4 according to FIG. 3C. The curve K4 shows an output signal with a prominent duplicated mode P2, which is perceived as significant distortion.

According to the invention this significant distortion is avoided, in that the threshold frequency GF of the frequency separating filter is set for example to 1200 Hz. FIGS. 4A-4C show this effect of the invention in three graphs. As in FIGS. 3A-3C, FIG. 4A shows the frequency response K3 of the signal amplitude A in dB of an input signal as a function of the frequency F in Hz between 0 and 4000 Hz. A flute tone has its base tone P1 at 1800 Hz.

FIG. 4B shows the frequency response of the frequency separating filter with a threshold frequency GF displaced to 1200 Hz. The curves K1, K2 show the attenuations D in dB as a function of the frequency F in Hz. The curve K1 shows a low-pass characteristic and the curve K2 a high-pass characteristic. A low-frequency and a high-frequency signal component are therefore available at the outputs of the frequency separating filter. The high-frequency signal component is now displaced upward in frequency by 100 Hz.

If the high-frequency signal component, the frequency of which has been displaced by 100 Hz, and the undistorted low-frequency signal component are added together, this gives a frequency response K5 according to FIG. 4C. The curve K5 shows an output signal without a prominent duplicated mode. The base tone P3 of the flute is reproduced almost without distortion.

With the inventive method it is therefore possible very effectively to avoid or render inaudible a disruptive "electrical" overlay. The inventive solution can be used independently of an on-off logic known from the prior art, thereby rendering it more advantageous.

If the threshold frequency GF of the frequency separating filter can be set freely in a specified frequency range, it is possible to reduce overlap artifacts considerably, in that an input signal is analyzed either in respect of signal volume A or tonality and the threshold frequency is then set accordingly. The threshold frequency is preferably set to a frequency, at which the input signal has particularly little signal amplitude A or is particularly lacking in tonality.

FIG. 5 shows a block circuit diagram of a typical exemplary embodiment of the invention. An input signal 100 of a hearing apparatus, for example a microphone signal, is split by a frequency separating filter 1 with a predefinable threshold frequency GF into a low-frequency and a high-frequency signal component 101, 102. The high-frequency signal component 102 is then distorted in a frequency distorter 2, its frequency being compressed or displaced for example. An output signal 103 thus distorted is fed to an input of an adding unit 3. The low-frequency signal component 101 passes through an all-pass filter 4, which rotates the phase so that a subsequent signal addition in the adding unit 3 does not result in signal cancellation in the region of the threshold frequency GF. The phase-rotated low-frequency signal component 104 is fed to a further input of the adding unit 3. An output signal 105 in the manner of a sum is available at the output of the adding unit 3.

To set or regulate the threshold frequency GF in the inventive manner, the input signal 100 is broken down into frequency bands 106 with the aid of a filter bank 5. The bands are then analyzed in a switching logic unit 6 in respect of their signal amplitude. The threshold frequency close to which the signal level is as low as possible is selected from a predefinable list of possible threshold frequencies, for example 1000 Hz, 1250 Hz, 1500 Hz and 2000 Hz. The frequency separating filter 1 is now cross-faded to this selected threshold frequency GF with an output signal 107 of the switching logic unit 6. The displacement of the threshold frequency GF means that artifacts resulting from overlapping bands of the frequency separating filter 1 are minimized.

Frequency distortion for better feedback suppression in hearing apparatuses can also produce an acoustic overlaying of sound from the hearing apparatus and sound reaching the eardrum in an acoustically direct manner in addition to the described "electrical" overlay, depending on the ear coupling.

This occurs for physical reasons, particularly at low frequencies. The problem also occurs here that undistorted signal components by way of the physical path are overlaid with intentionally distorted signal components by way of the hearing apparatus in the same frequency band, producing unwanted artifacts. Since this preferably occurs at low frequencies, the countermeasure would be to raise the threshold frequency GF of the frequency separating filter 1 so high that the resulting overlay becomes insignificant. However this increases the risk of feedback whistling in the low frequency band.

One advantageous remedy for this is to combine the inventive method with a feedback detector 7 according to FIG. 5. If feedback whistling is detected—this generally being the more disruptive artifact—the threshold frequency GF is lowered appropriately by the feedback detector 7 and the feedback whistling is quickly suppressed. The overlay artifacts that in some instances occur for a short time in this process and are described above represent the lesser evil here. Once the feedback whistling has been successfully suppressed and/or when dominant/tonal signal components occur in the lower band, it is possible to raise the threshold frequency GF of the frequency separating filter 1 again.

The invention claimed is:

1. A method for operating a hearing apparatus, which comprises the steps of:

splitting an input signal of the hearing apparatus into a low-frequency signal component and a high-frequency signal component via a frequency separating filter; and setting a predefinable threshold frequency of the frequency separating filter by analyzing the input signal so that artifacts in an output signal of the hearing apparatus are reduced, the predefinable threshold frequency being determined by analyzing one of a signal level or a tonality of the input signal.

2. The method according to claim 1, which further comprises:

distorting the high-frequency signal component resulting in a distorted high-frequency signal component; and overlaying the low-frequency signal component and the distorted high-frequency signal component to form the output signal.

3. The method according to claim 2, which further comprises identifying feedback, with the predefinable threshold frequency being momentarily lowered when feedback is identified.

4. The method according to claim 1, which further comprises setting the predefinable threshold frequency to a frequency, at which the input signal has at least one of a lowest possible signal level and a lowest possible tonality.

5. A hearing apparatus, comprising:

a frequency separating filter characterized by a threshold frequency and splits an input signal into a low-frequency signal component and a high-frequency signal component; and a first means for setting the threshold frequency based on an analysis of the input signal so that artifacts in an output signal of the hearing apparatus are reduced, said first means being coupled to said frequency separating filter, said first means determining the threshold frequency by analyzing one of a signal level or a tonality of the input signal.

6. The hearing apparatus according to claim 5, further comprising:

a frequency distorter for distorting the high-frequency signal component into a distorted high-frequency signal component and coupled to said frequency separating filter; and an adding unit, which forms the output signal by overlaying the low-frequency signal component with the distorted high-frequency signal component.

7. The hearing apparatus according to claim 5, wherein said first means sets the threshold frequency to a frequency, at which the input signal has at least one of a lowest possible signal level and a lowest possible tonality.

8. The hearing apparatus according to claim 5, further comprising a feedback detector for momentarily lowering the threshold frequency when feedback is identified and thus providing feedback suppression, said feedback detector coupled to said frequency separating filter.

* * * * *